US006506226B1

(12) United States Patent
Chen et al.

(10) Patent No.: US 6,506,226 B1
(45) Date of Patent: Jan. 14, 2003

(54) HARD METAL OR CERMET BODY AND METHOD FOR PRODUCING THE SAME

(75) Inventors: Limin Chen, Oakmont, PA (US); Walter Lengauer, Leobendorf (AT); Hans Werner Daub, Köln (DE); Klaus Dreyer, Essen (DE); Dieter Kassel, Witten (DE); José Garcia, Vienna (AT); Georg Korb, Baden (AT)

(73) Assignee: Widia GmbH, Essen (DE)

( * ) Notice: Subject to any disclaimer, the term of this patent is extended or adjusted under 35 U.S.C. 154(b) by 0 days.

(21) Appl. No.: 09/674,739

(22) PCT Filed: Jun. 26, 1999

(86) PCT No.: PCT/DE99/01875

§ 371 (c)(1),
(2), (4) Date: Nov. 3, 2000

(87) PCT Pub. No.: WO00/03047

PCT Pub. Date: Jan. 20, 2000

(30) Foreign Application Priority Data

| | | |
|---|---|---|
| Jul. 8, 1998 | (DE) | 198 30 385 |
| Oct. 2, 1998 | (DE) | 198 45 376 |
| May 14, 1999 | (DE) | 199 22 057 |

(51) Int. Cl.[7] ..... B22F 3/12; C22C 29/00

(52) U.S. Cl. ..... 75/237; 428/548; 419/13; 419/14; 419/16; 419/25; 419/38; 419/53; 419/57

(58) Field of Search ..... 419/13, 14, 16, 419/25, 39, 53, 56, 38, 57; 428/547, 548; 75/237

(56) References Cited

U.S. PATENT DOCUMENTS

| | | | | |
|---|---|---|---|---|
| 5,147,996 A | * | 9/1992 | Carlin | 219/76.12 |
| 5,181,953 A | | 1/1993 | Nakano et al. | 75/237 |
| 5,370,195 A | * | 12/1994 | Keshavan et al. | 175/420.2 |
| 5,494,635 A | * | 2/1996 | Bennett | 419/10 |
| 5,649,279 A | * | 7/1997 | Gustafson et al. | 419/25 |
| 5,761,593 A | * | 6/1998 | Ostlund et al. | 419/29 |
| 6,344,265 B1 | * | 2/2002 | Blomstedt et al. | 407/119 |

FOREIGN PATENT DOCUMENTS

| | | |
|---|---|---|
| DE | 27 17 842 A1 | 10/1978 |
| DE | 39 96 129 C2 | 5/1990 |
| DE | 44 23 451 A1 | 11/1995 |
| EP | 0 516 165 A2 | 12/1992 |
| EP | 0 603 143 A2 | 6/1994 |
| EP | 0 635 580 A1 | 1/1995 |
| EP | 0 687 744 A2 | 12/1995 |
| EP | 0 697 465 A1 | 2/1996 |
| EP | 0 822 265 A2 | 2/1998 |

* cited by examiner

*Primary Examiner*—Ngoclan Mai
(74) *Attorney, Agent, or Firm*—Herbert Dubno

(57) ABSTRACT

The invention relates to a hard metal or cermet body with a hard material phase consisting of WC and/or at least one carbide, nitride, carbonitride and/or oxicarbonitride of at least one of the elements from group IVa, Va, or VIa of the periodic table and a binding metal phase consisting of Fe, Co and/or Ni, said binding metal phase making up 3 to 25 mass %. In particular, WC crystallites should protrude beyond the hard metal or cermet surface of the by 2 to 20 μm in order to improve the adhesion of surface layers that are applied.

18 Claims, 11 Drawing Sheets

HARD METAL OR CERMET BODY AND METHOD FOR PRODUCING THE SAME

CROSS REFERENCE TO RELATED APPLICATIONS

This application is a national stage of PCT/DE99/01875 filed Jun. 26, 1999 and is based upon German national applications 198 30 385.8 of Jul. 8, 1998, 198 45 376.0 of Oct. 2, 1998 and 199 22 057.3 of May 14, 1999 under the International Convention.

SPECIFICATION

FIELD OF THE INVENTION

The invention relates to a hard metal or cermet body with a hard material phase of WC and/or at least one carbide, nitride, carbonitride and/or oxycarbonitride of at least one of the elements of Group IVa, Va or VIa of the classification of elements and a metal binder phase of Fe, Co and/or Ni, whose proportion amounts to 3 to 25% by mass.

The invention relates further to a method for producing such a hard metal or cermet body through mixing, grinding, granulation and pressing of an initial mixture containing the corresponding components and subsequent sintering thereof.

BACKGROUND OF THE INVENTION

In EP 0 344 421 A1 a cermet is proposed which should have either an average grain size of the hard material phase in the surface layer as compared to a core with a penetration depth of 0.05 mm, ranging between 0.8–1.2 times of the average grain size of the hard material phase in the cermet body core, or at the same penetration depth has a binder phase which ranges between 0.7 to 1.2 times of the corresponding average binder content of the cermet core, or wherein the hardness in the aforementioned penetration depth ranges between 0.95 and 1.1 times the average hardness of the cermet core. For the production of this cermet, the initial mixture is sintered after grinding, mixing and preliminary pressing. In a first step it is sintered under vacuum or in an inert gas atmosphere at up to 1300° C. or below, while in a second step it is sintered at over 1330° C. at a nitrogen pressure of 0.1 to 20 Torr (13.3 Pa to 2.66 Pa$\times 10^3$ Pa). The nitrogen pressure is increased with increasing temperature.

The EP 0 368 336 B1 describes a cermet substrate with a hard surface layer, wherein the region with the maximal hardness lies at a depth between 5 $\mu$m and 50 $\mu$m from the substrate surface and the substrate surface has a hardness of 20 to 90% of the maximal hardness. For the production of this cermet the prepressed mixture is subjected to an initial temperature increase up to 1100° C. in vacuum and to a subsequent temperature increase from 1100° to a temperature range between 1400° C. and 1500° C. in a nitrogen atmosphere. It is subsequently sintered in vacuum.

The EP 0 374 358 B1 describes a method for producing a cermet with 7 to 30% by weight of a binder phase and a hard phase of titanium carbide, titanium nitride and/or titanium carbonitride with 35 to 59% by weight Ti, 9 to 29% by weight W, 0.4 to 3.5% by weight Mo, 4 to 24% by weight of at least one metal from the group of Ta, Nb, V and Zr, 5.5 to 9.5% by weight N and 4.5 to 12% by weight C. The formulated, mixed, dried and prepressed mass is sintered in such a manner that the temperature is increased in vacuum to 1350° C., whereby the nitrogen atmosphere is set at 1 Torr (133 Pa) at 1350° C., the partial nitrogen pressure together with the temperature of 1350° C. are gradually increased up to the sintering temperature, whereby the nitrogen atmosphere is set at 5 Torr (665 Pa) at the sintering temperature.

The EP 0 492 059 A2 describes a cermet body, whose hardness at a penetration depth of no less than 1 mm is higher than in the cermet interior, whereby the binder content can be reduced in a layer thickness of 0.5 to 3 $\mu$m with respect to the core substrate. The cermet should have a hard material coating whose thickness ranges between 0.5 to 20 $\mu$m of carbides, nitrides, oxides and borides of titanium and $Al_2O_3$. For the production of this body a green compact is at first heated under vacuum to a temperature between 1100° C. and 1400° C., then nitrogen gas is introduced up to a pressure level at which the partial nitrogen pressure ranges between 5 and 10 Torr (665 and 1330 Pa), so that the nitrogen is removed from the substrate surface. The sintering and the subsequent cooling are performed in a non-oxidizing atmosphere, such as a vacuum or an inert gas atmosphere. After that the body is coated by CVD or PVD.

The production of a super tough cermet is proposed in EP 0 499 223, wherein the relative binder concentration in a 10 $\mu$m thick layer close to the surface is 5 to 50% of the average medium content of binder in the cermet core, and in the underlying layer of 10 $\mu$m to 100 $\mu$m penetration depth the binder content at 70 to 100% in relation to the cermet core. In the method used therefore the sintering is performed under nitrogen gas with a constant pressure of 5 to 30 Torr (665 to 3.99$\times 10^3$ Pa) and the cooling is performed under vacuum with a cooling rate of 10 to 20° C./min.

The EP 0 519 895 A1 discloses a cermet with a triple-layer border zone, wherein a first layer reaches to a depth of 50 $\mu$m TiN, the next layer to a depth of 50 to 150 $\mu$m penetration depth with a binder enrichment and the next layer of 150 $\mu$m to 400 $\mu$m is conceived with a binder reduction relative to the inner cermet core. For this purpose the sinter body is treated in an atmosphere of $N_2$ and or $NH_3$, optionally in combination with $CH_4$, CO, $CO_2$ at 1100° to 1350° C., for 1 to 25 hours at atmospheric pressure or at a pressure above 1.1 bar (1.1$\times 10^5$ Pa).

The cermets known to the state of the art have at their surface either different binder contents, which can be recognized by their spotted appearance, or tend to adherence of the binder to the sinter substrate, which due to the thereto related reaction, leads to changes in the composition of the contact zone. A further disadvantage of the cermets known to the state of the art is that, at increased contents of metal binder in the surface, the adhesion of thereto applied wear-resistant layers is poor. To the extent that the nickel proportion increases in the surface, CVD coating becomes impossible. Therefore the DE 44 23 451 A1 proposes a cermet which has a hard material content of 95 to 75% mass and 5 to 25% by mass Co and/or Ni binder, whereby the hard material phase consists of carbonitrides with cubic B1 crystal structure and 30 to 60% by mass Ti, 5 to 25% by mass W, 5 to 15% by mass Ta, up to 70% by mass of which can be replaced by Nb, 0 to 12% by mass Mo, 0 to 5% by mass V, 0 to 2% by mass Cr, and 0 to 1% by mass Hf and/or Zr. The (C+N) content in the carbonitride phase should be >80% by mol, whereby the nitrogen content ratio N/(C+N) ranges between 0.15 and 0.7. In a certain surface depth of 0.01 to 3 $\mu$m, the proportion of the binder phase with respect to the underlying cermet core area is lower than 30% by mass. In this zone the titanium content is 1.1 to 1.3 times higher than in the underlying cermet core area, while the contents of tungsten, tantalum, as well as any content of molybdenum, niobium, vanadium and/or chromium are present only in an amount of 0.7 to 1 times in relation to the underlying cermet core areas. In an alternative embodiment of this cermet in the same surface border zone the relative content of binder phase is 90% by mass, the relative Ti content 100% to 120% and the sum of contents of tungsten, tantalum and optionally molybdenum, niobium, vanadium, chromium ranges between 80% by mass and 110% by mass, each in relation to the inner cermet core.

This border structure according to the aforementioned reference is produced through a process of cermet manufacturing, according to which the green compact produced through mixing, grinding, granulation and pressing is at first heated under vacuum up to the melting point of the binder phase at a pressure of $10^{-1}$ mbar (10 Pa). During the further heating from the melting temperature of the binder phase to the sintering temperature, which is maintained from 0.2 to 2 hours, and a subsequent cooling to 1200° C. a gas mixture of $N_2$ and Co is introduced into the oven atmosphere, with a $N_2/(N_2+CO)$ ratio between 0.1 and 0.9 which fluctuates within a period of time between 40 to 240 sec around a pressure on the average of 10% to 80% of an average pressure. The average pressure as well as the aforementioned ratio are selected depending on the binder content.

The EP 0 687 744 A2 also describes a nitrogen-containing sintered hard metal alloy with at least 75% by weight and a maximum of 95% by weight of hard phase content, containing titanium, an element of the Group VIa of the classification of elements and WC, the balance being a binder phase of nickel and cobalt. The alloy has 5% by weight to 60% by weight titanium in the form TiC and 30% by weight up to 70% by weight of a metal in the form of a metal carbide. The sintered hard metal alloy should have a soft outermost surface layer, consisting of a binder phase and WC. Below this outermost layer lies a layer with a thickness of 3 $\mu$m to 30 $\mu$m, which should consist substantially of WC with low metal binder contents.

A sintered hard metal alloy of the aforementioned composition is also described in EP 0 822 265 A2. The sintered body produced accordingly should have a border area subdivided into three layers, of which the outermost layer has a WC-content between 0 and 30% by volume, the balance being binder phase, the middle layer has 50% by volume to 100% by volume WC, the balance being binder phase and a third innermost layer has a WC content by volume between 0 and 30%, the balance being binder.

OBJECT OF THE INVENTION

It is the object of the present invention to create a hard metal or cermet body suitable for CVD or PVD coating, whose surface insures an improved adhesion capability for the layers of hard materials deposited from the gas phase, such as diamond, cubic boron nitride, carbon nitrides, fuller's earth, as well as metallic hard materials (carbides, nitrides, carbonitrides or oxycarbonitrides of the elements of Groups IVa-VIa of the classification of elements), as well as other layers which contain at least one of the elements B, C, N or O.

SUMMARY OF THE INVENTION

This object is achieved in a hard metal or cermet body which, according to the invention, is characterized in that WC crystallites project from the body's surface by 2 to 20 $\mu$m, preferably by 5 to 10 $\mu$m. By means of these crystals a coarse-grained surface morphology is produced, which insures the adhesion of the applied surface layers due the interlocking of the crystallites with the deposited phases. These WC crystallites are embedded in the border zone adjacent the surface in such manner that even while grinding test work is performed they are not dislodged. The created surface roughness provides an ideal "anchoring" for the application of surface coatings.

The WC content in the total hard material phase of the hard metal or cermet body ranges between a minimum of 50% by mass and a maximum of 96% by mass. Preferably the WC crystallites at the body border zone or surface, form a composition with up to 50% by volume of a cubic phase of a further hard material of a different composition and binder metal parts. This cubic phase can consist substantially of carbides, nitrides, carbonitrides and/or oxycarbonitrides of at least one element (with the exception of W) of the Groups IVa, Va and/or VIa of the classification of elements. The cubic phase can be conceived as single-phased or multi-phased. It can consist for instance of Ti(C,N) and (Ti,W)C. Also metals of Groups IVa, Va and/or VIa of the classification of elements, preferably W, Ta, Nb, Mo and Cr can be incorporated in the structure of the hard metal or cermet body, particularly in border zones close to the surface of the body. The cubic phases in the border zone can have either a homogeneous structure or a local grain border structure, as is basically known in cermets.

The present invention comprises especially cermet bodies whose phases with cubic crystalline structure contain 30 to 60% by mass titanium, 5 to 15% by mass tantalum and/or niobium, 0 to 12% by mass molybdenum, 0 to 5% by mass vanadium, 0 to 2% by mass chromium, 0 to 1% by mass hafnium and/or zirconium, whereby in the binder phase up to 2% aluminum and/or metallic tungsten, titanium, molybdenum, vanadium and/or chromium are dissolved.

The border zones close to the surface can be substantially homogeneous or have a gradient in their composition. They can have surface-close border zones of different compositions, whereby in a first outer layer at the body surface and reaching to a depths between 2 $\mu$m and 3 $\mu$m there is a carbonitride phase substantially free of binder phase, which borders an underlying middle layer with a thickness of 5 $\mu$m to 150 $\mu$m of a substantially pure WC-Co-composition, and which is followed by a third innermost layer with a thickness of at least 10 $\mu$m and a maximum of 650 $\mu$m, wherein the content of the binder phase and of the IVa and/or Va elements increase to the corresponding values which in the body interior are substantially constant, while the tungsten content decreases to the substantially constant value thereof in the inner body. The different layers of the aforedescribed sintered body blend continuously into one another, whereby preferably titanium is used as the metal of the carbonitride phase. The content of titanium and/or of a further element of the Groups IVa to VIa of the classification of elements, with the exception of tungsten, is at a maximal level in the outer layer, decreases steeply to a minimal value in the transition to the middle layer, and increases gradually in the transition to the third innermost layer, to a penetration depth of approximately 800 $\mu$m measured from the surface, reaching an average value corresponding to the content in the total composition in the body interior, which however is below the level of the titanium or other metallic parts in the outer layer. Correspondingly the nitrogen content in the middle layer is minimal and increases in the transition to the outermost layer to proportions above the average nitrogen content of the alloy present in the inner core. By contrast, in the transition from the outermost layer to the middle layer the contents of tungsten and cobalt increase clearly. Optionally the hard material phase WC can be formed already during sintering from (Ti,W)C or (Ti,W) (C,N). Preferably the binder phase content in the middle layer amounts to maximum 0.9 times the binder phase content in the body interior, while the tungsten content in this middle layer amounts to at least 1.1 times the tungsten content existing in the body interior.

Alternatively it is also possible to have such border zones wherein the individual layers are not strictly separated from each other, but wherein the respective contents of metallic and non-metallic components of the alloy change gradually over wide transition areas. A body according to the invention can fulfill the following conditions in three layers forming the border zone:

In an outer layer, which closely follows the body surface or the border zone with a penetration depth of 1 to maximum 3 μm and reaching down to a depth between 10 μm and 200 μm, the tungsten and the binder phase content amount to a maximum of 0.8 times the content resulting from the general composition. In this layer the tungsten and the binder phase content increase substantially continuously towards the body interior, while the nitrogen content decreases continuously towards the body interior. In an underlying middle layer of a thickness between 20 μm and 400 μm, with the advancing penetration depth the tungsten and binder phase contents pass through a maximal level, while the contents of elements of the Groups IVa and/or Va of the classification of elements pass through a minimal level. In a third innermost layer, which reaches to a penetration depth measured from the body surface of maximum 1 mm. the tungsten and binder phase contents decrease to the substantially constant values in the body interior, which correspond to the content in the general composition, and the contents of elements of the Groups IVa and Va of the classification of elements, particularly titanium, increase to the substantially constant values. The nitrogen content remains substantially constant in the transition from the middle layer to the innermost layer towards the body interior.

The alloys of the body of the invention can contain up to 2% by mass chromium and/or molybdenum, as well as between 3 to 40% by mass TiCN or up to 40% by mass TiC and/or TiN in the hard material phase TiCN.

Advantageously the hard metal or cermet body of the invention is coated with at least one hard material layer and/or a ceramic layer ($Al_2O_3$) or diamond, cubic boron nitride or similar layers.

In the case of nitrogen-free mixtures of hard materials and binder metals, the same are pressed into a green compact and at first are heated in vacuum to approximately 1200° C., and subsequently in an inert gas atmosphere to a temperature between 1200° C. and the sintering temperature, whereafter at the latest when the sintering temperature is reached, an atmosphere containing nitrogen and optionally carbon is set at a pressure between $10^3$ and $10^7$ Pa, preferably between $5\times10^3$ Pa and $5\times10^4$ Pa. To the extent that the sintering temperature may not yet have been reached, the heating up to this temperature continues and the same is maintained over a period of at least 20 minutes, or in this interval of at least 20 minutes only a slight cooling of maximum 2° C./min is performed. In the subsequent cooling of the sintered body, the set nitrogen and optionally carbon atmosphere is maintained until at least 1000° C. are reached.

If the initial mixture contains nitrogen proportions of at least 0.2% by mass in relation to the total hard material mass, the nitrogen-containing gas can be introduced later into the oven atmosphere, however at the latest when the sintering temperature is reached and, corresponding to the nitrogen content in the initial mixtures, it can be introduced also at a lesser partial pressure. In any case it has to be insured through the process and/or the initial mixture that there is a sufficiently high carbon content and tungsten content for the formation of the WC crystallites at the surface. In certain cases the sintering time has to be correspondingly extended.

In a variant of the process it is also possible to set the nitrogen-containing and optionally the carbon-containing atmosphere by introducing precursors, i.e. nitrogen-containing and optionally carbon-containing crucible materials, so that under the existing temperature and pressure nitrogen and carbon are formed in situ.

The size and frequency of the WC crystallites can be influenced by the time period and by the gas composition while the sinter body is at eutectic temperatures. Thereby longer treatment times and a higher content of carbon lead to larger and/or more frequently occurring WC-crystallites.

In an embodiment of the invention, the sinter body is heated up to 1200° C. during the heating phase and this temperature is maintained for at least 20 minutes, preferably more than an hour, before continuing the further heating up to the sintering temperature.

Within the framework of the present invention there is also a process technology wherein, at first, in the heating phase up to approximately 1200° C., the body is exposed to a vacuum, which is then replaced by an inert-gas atmosphere (e.g. a noble gas atmosphere).

The inert-gas pressure of $10^3$ to $10^4$ Pa is maintained until the sintering temperature is reached, after which a nitrogen-containing and optionally carbon-containing atmosphere is established at a higher pressure of more than $10^4$ Pa above 1450° C., preferably close to 1500° C.

According to a further embodiment of the invention, after a holding period of at least 0.5 hours, the sintered body of hard metal or a cermet can be subjected to a "pendular annealing", i.e. to a temperature setting wherein at least once, preferably several times, the temperature surpasses or falls below the eutectic melting point by at least 20° C., preferably at least 50° C. in an oscillating manner. Preferably the heating and cooling rates, as well as the speed with which the heating and cooling rates surpass or fall below the eutectic melting point are at maximum 10° C./min. However cooling and/or heating speeds between 2° C./min and 5° C./min are preferred.

In a further embodiment of the invention, the gas mixture atmosphere of $N_2$ and CO established after the sintering temperature was reached, can be selected with a ratio of $N_2/(N_2+CO)$ between 0.1 and 0.9.

Finally within the framework of the present invention, it is possible, after reaching the sintering temperature, to set pressures oscillating around an average of the atmosphere containing nitrogen and optionally carbon, whereby the pressures deviate by 10 to 80% from an average value selected depending on the binder material. A corresponding process technology is explained for instance in DE 44 23 451 A1 to which reference is made.

According to a further embodiment of the invention, the surface of the finished sintered compact can be subjected to an etching treatment by means of gases or liquids, through which the WC crystallites are more clearly defined due to relief formation. This step can be particularly useful for the removal of binder metal parts from the substrate body surface, since these are particularly undesirable in the case of a diamond coating.

BRIEF DESCRIPTION OF THE DRAWING

The present invention is subsequently further explained with reference to the drawing in which.

SPECIFIC DESCRIPTION

Figure 1:
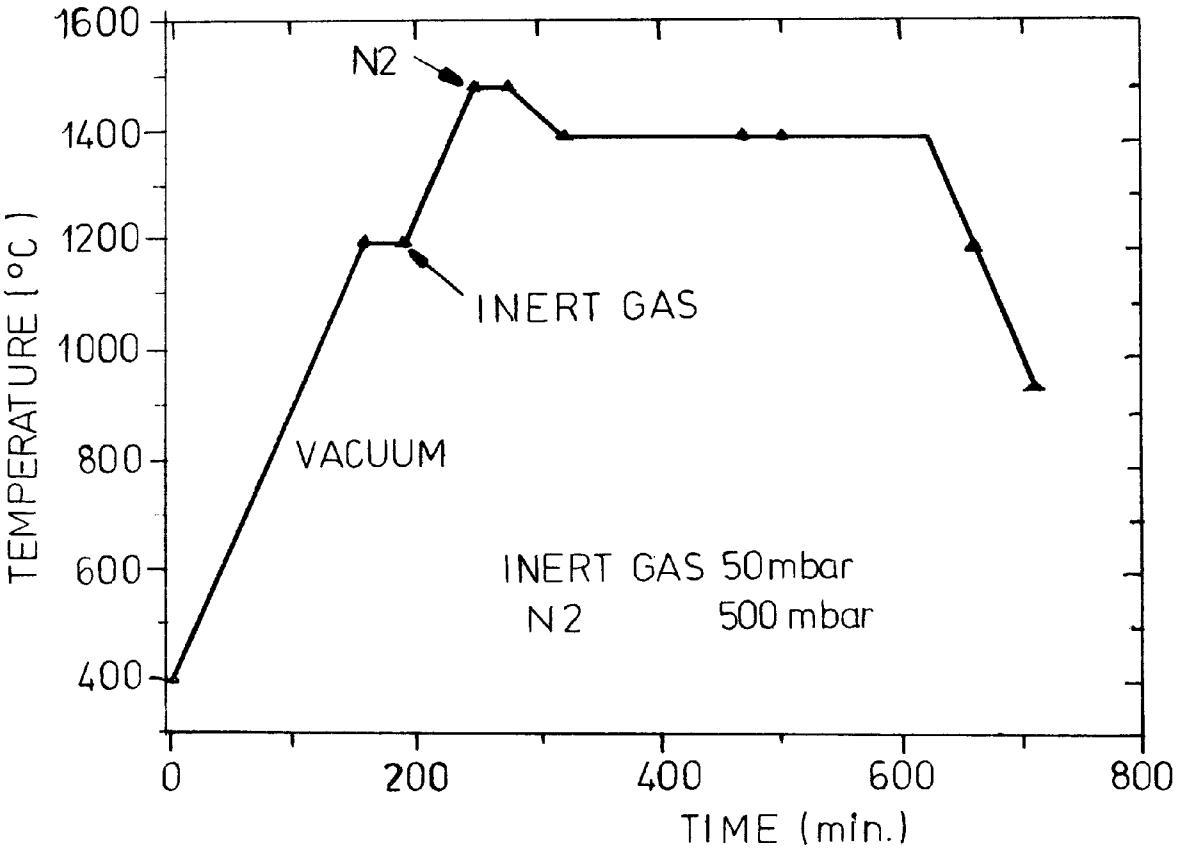
FIG. 1 is a temperature-time diagram.

A WC—TiC—TaC—NbC—Co green compact with a content of 1.3% by mass TiC is subjected to the temperature regimen which can be seen from FIG. 1. At first the green compact was heated in a vacuum to a temperature of 1200° C. which was then maintained for approximately half an hour. After that an inert gas at a pressure of $5\times10^3$ Pa was introduced and the heating was continued until the sintering point was reached at 1485° C. When the sintering point was reached, the inert-gas atmosphere was replaced by a nitrogen atmosphere at a pressure of $5\times10^4$ Pa. The sintering temperature was maintained for approximately half an hour, after which the oven atmosphere was cooled down to 1400° C. The temperature of 1400° C. was maintained for approximately 5 hours, after which the sintered body was cooled down to room temperature. After the sintering temperature was reached and until the temperature decreased to 1000° C. in the cooling phase, the nitrogen atmosphere was maintained at the mentioned pressure.

Figure 2:
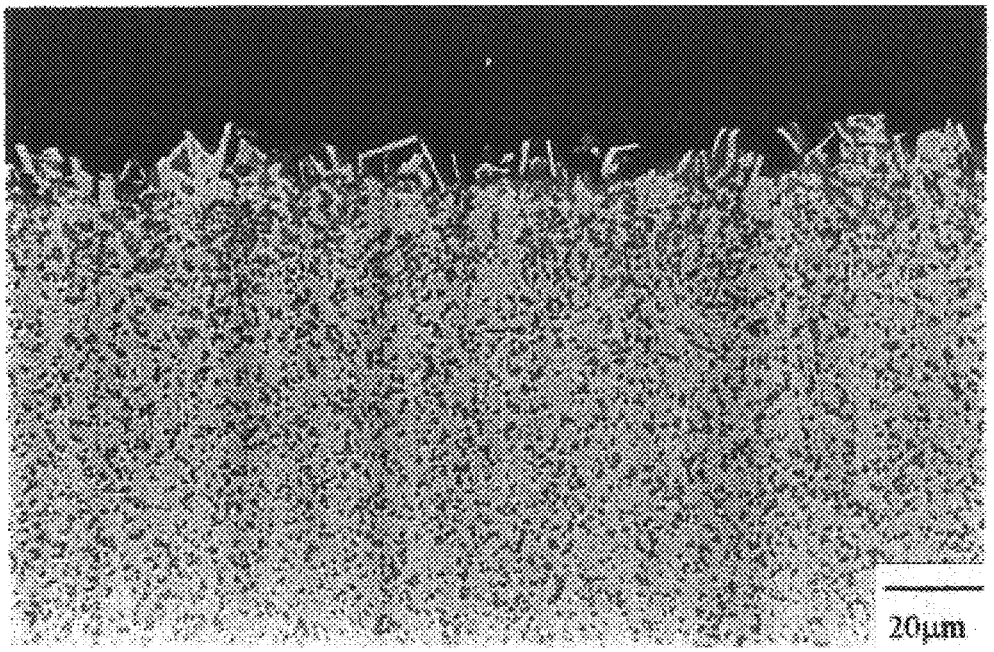
FIGS. 2 and 3 are microphotographs showing structure formations on a sintered compact border zone with various WC-crystallites.
Figure 3:
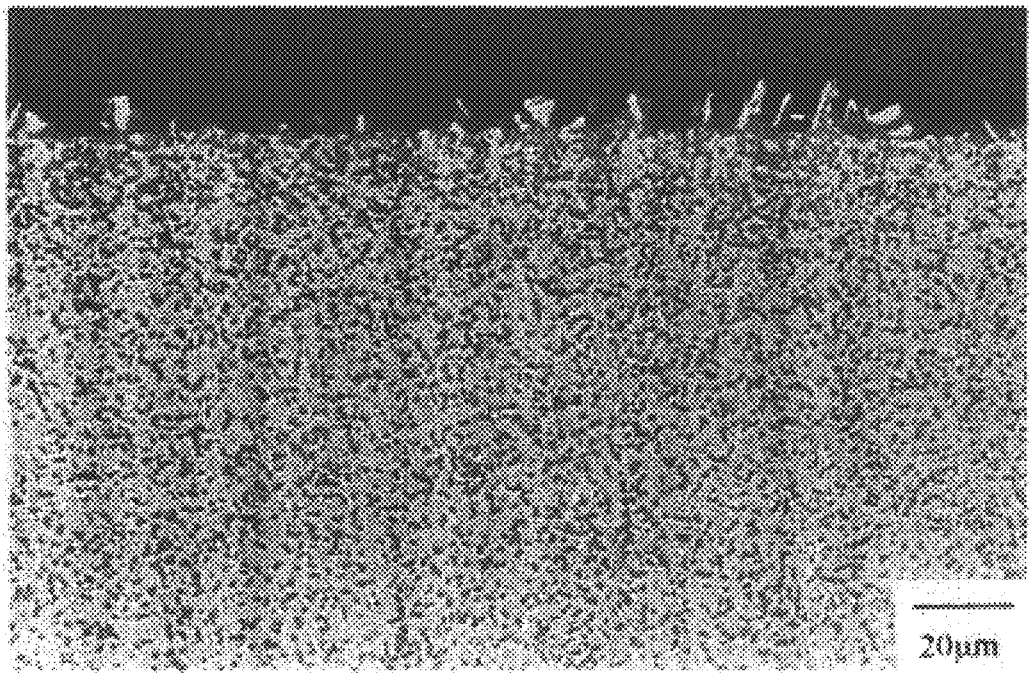

FIGS. 2 and 3 show structure formations of the sintered compacts treated this way having the same quantitative composition with WC crystallite formations of different sizes on the surface. In the initial mixture and in the gas atmosphere of the sintered body of FIG. 2 there was a higher proportion of carbon, this being the reason why in the sintered body of FIG. 2 the WC crystallite formation appears stronger on the body surface. By comparison, the sintered body of FIG. 3 has fewer and smaller WC crystallites than the one of FIG. 2.

Figure 4:
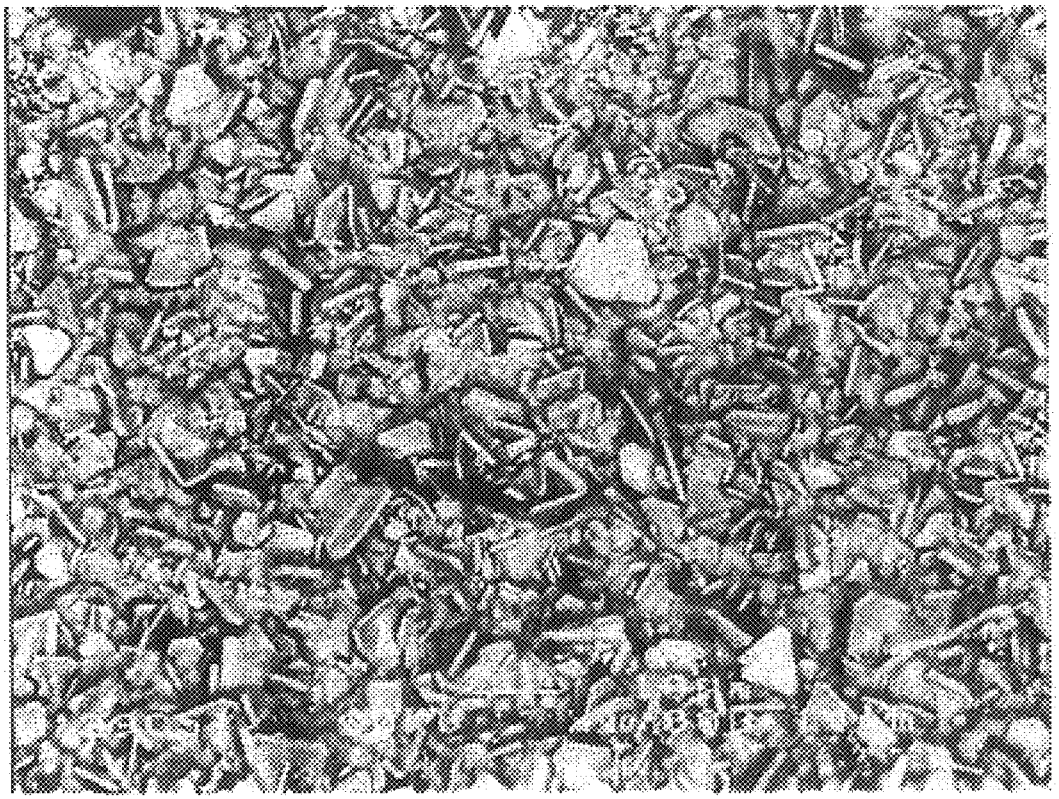
FIG. 4 is a scanning electron microscope image of the surface of the sintered body according to FIG. 2.
Figure 5:
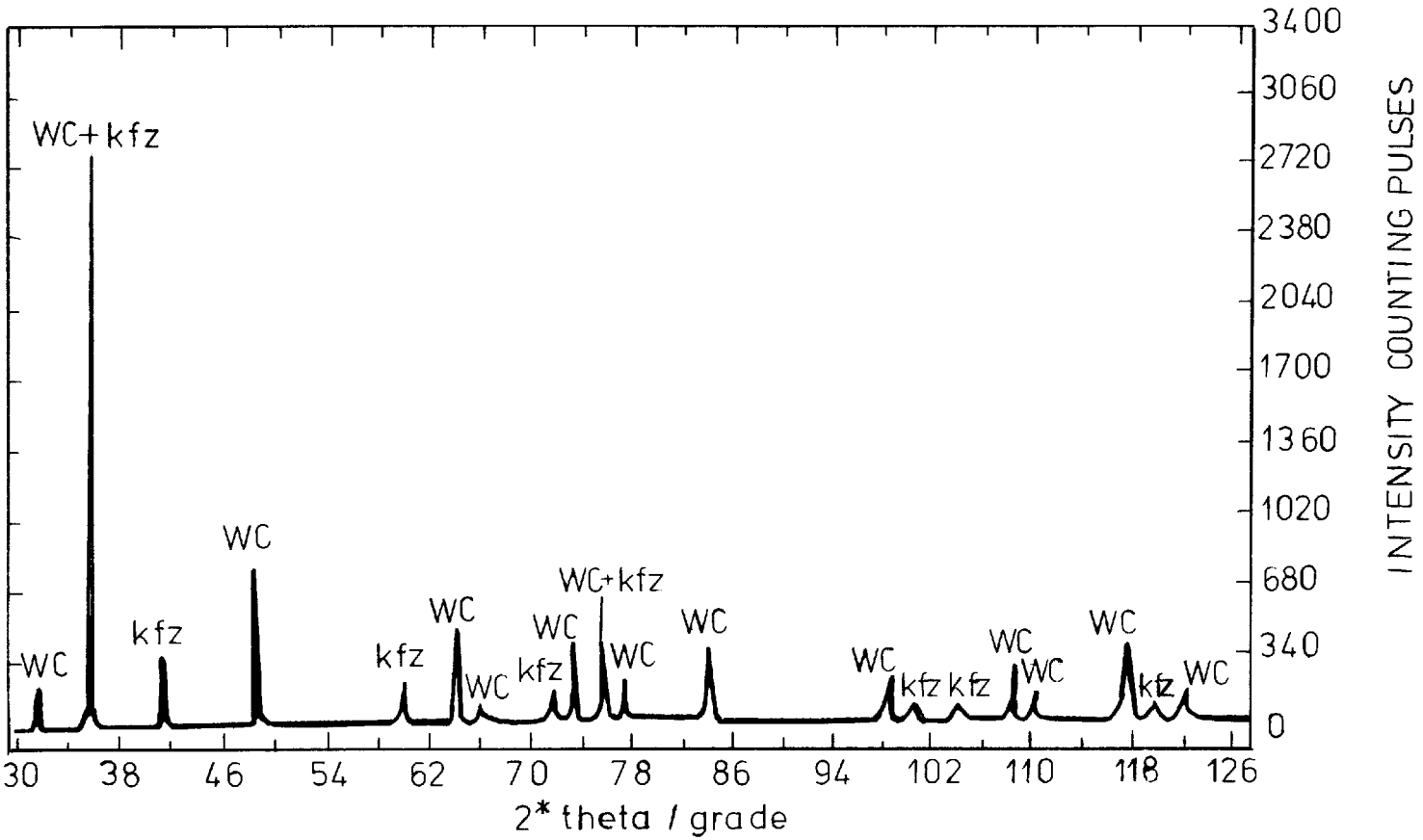
FIG. 5 is a diffractogram of the sintered body surface of an embodiment example.

FIG. 4 shows a scanning electron microscope image, from which it can be seen that the WC crystallites are firmly embedded in the surface border zone, from which they project by 2 $\mu$m to 20 $\mu$m. Depending on the setting of the sintering conditions, i.e. the setting of the atmosphere, between the WC crystallites there are more or less large parts of a surface-centered cubic phase (Ti, Ta, Nb, W)(C,N), as well as binder phase. From the diffractogram of FIG. 5 of the same sintered body alloy, besides (hexagonal) WC parts, face-centered cubic phases (marked kfz) can be seen with a grid parameter of 0.4368 nm. The proportion of tantalum and niobium carbides which can be estimated therefrom amounts to approximately 20% by mol. From the peak shape of the diffraction line a nonhomogeneous and/or at least biphased structure of the face-centered cubic phase can be deduced, namely one such as known in cermets with a core-shell structure.

Figure 6:
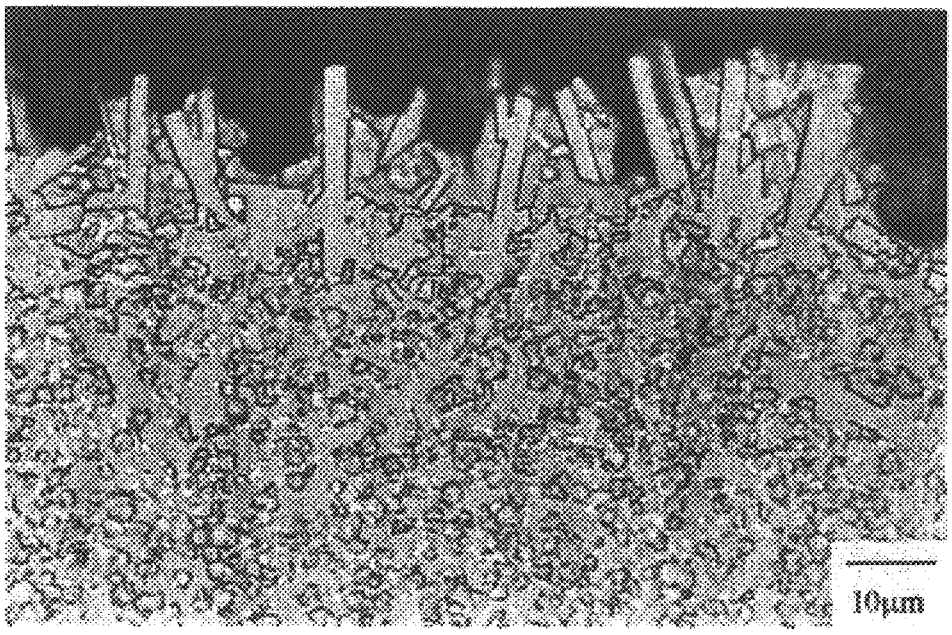
FIGS. 6 and 7 are microphotograph formations of border zone structures of various sintered bodies.

FIG. 6 shows a border zone structure of a sintered body with a different mixture, which has a larger content of TiC, namely 6% by mass. During the treatment of this sintered body in the same prescribed manner, larger parts of a face-centered cubic phase are formed between the WC crystallites projecting from the surface. The WC crystallites are clearly larger than in sintered bodies which have only a smaller amount of carbides in the initial mixture.

Figure 7:
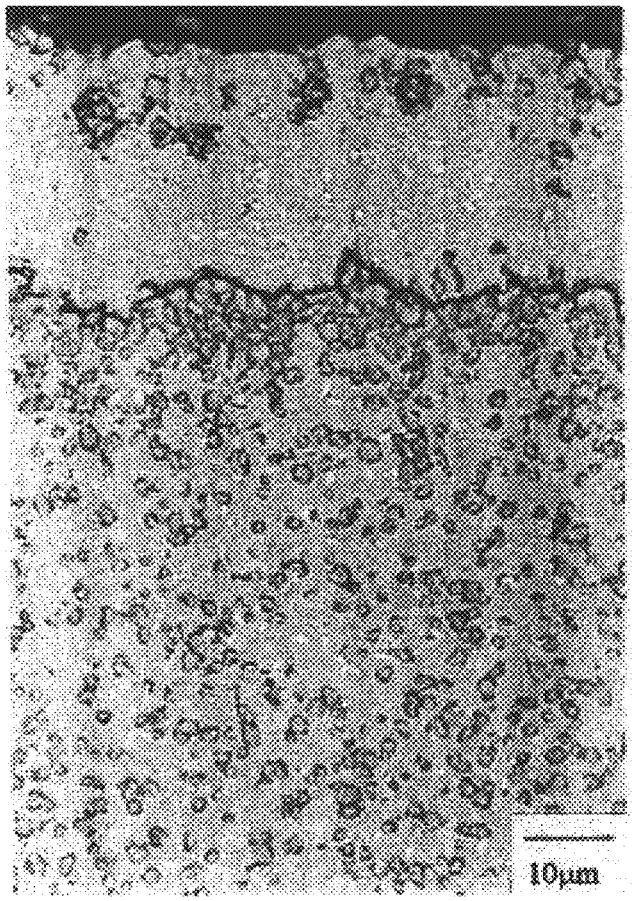
Figure 8:
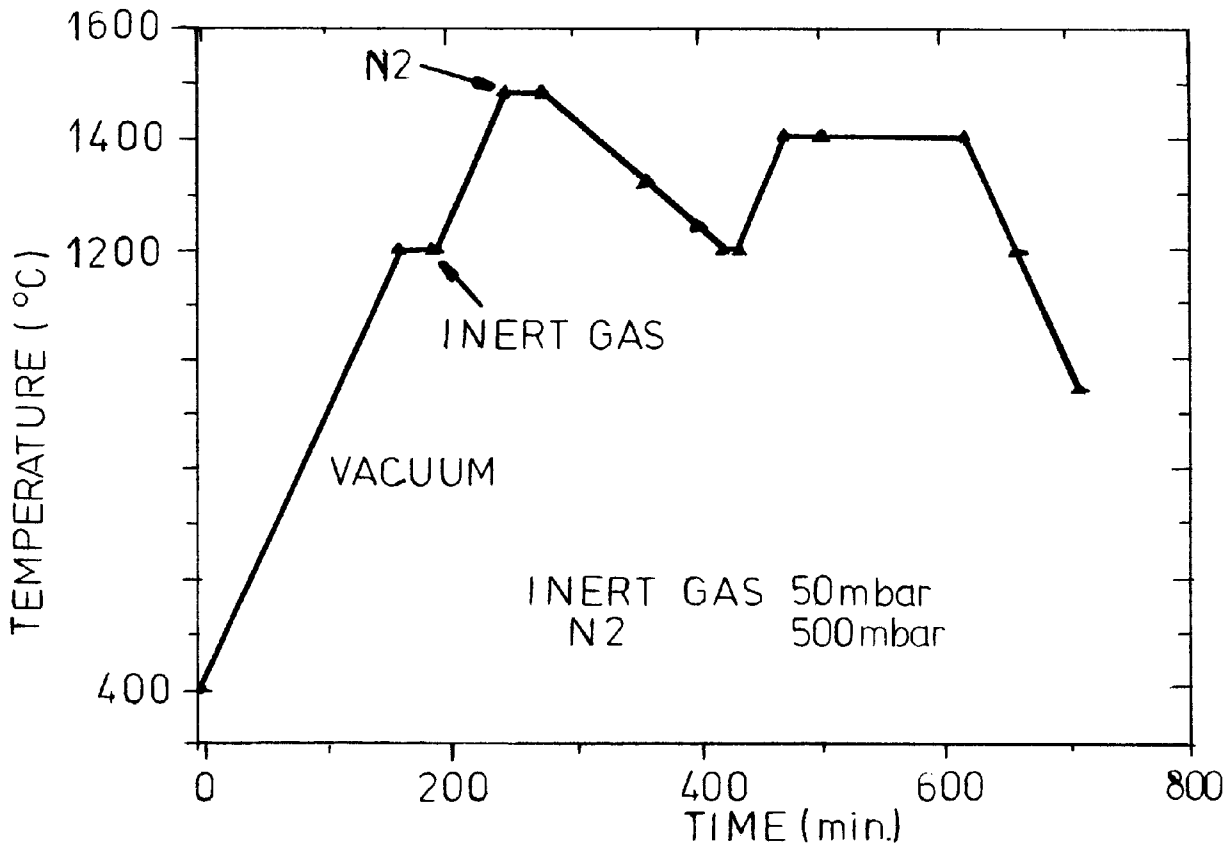
FIG. 8 is a temperature-time diagram in a further embodiment.

A border structure of a further sintered sample is shown in FIG. 7. The initial mixture used there contains approximately twice the amount of TiN than the sintered body treated before. The structure in FIG. 7 was obtained through a body treatment corresponding to FIG. 8. Different from the temperature management of FIG. 1, after the holding time at sintering temperature, the body is cooled down to 1200° C. and then again reheated to 1400° C. The temperature of 1400° C. was maintained for approximately 2½ hours, before the body was cooled.

Figure 9:
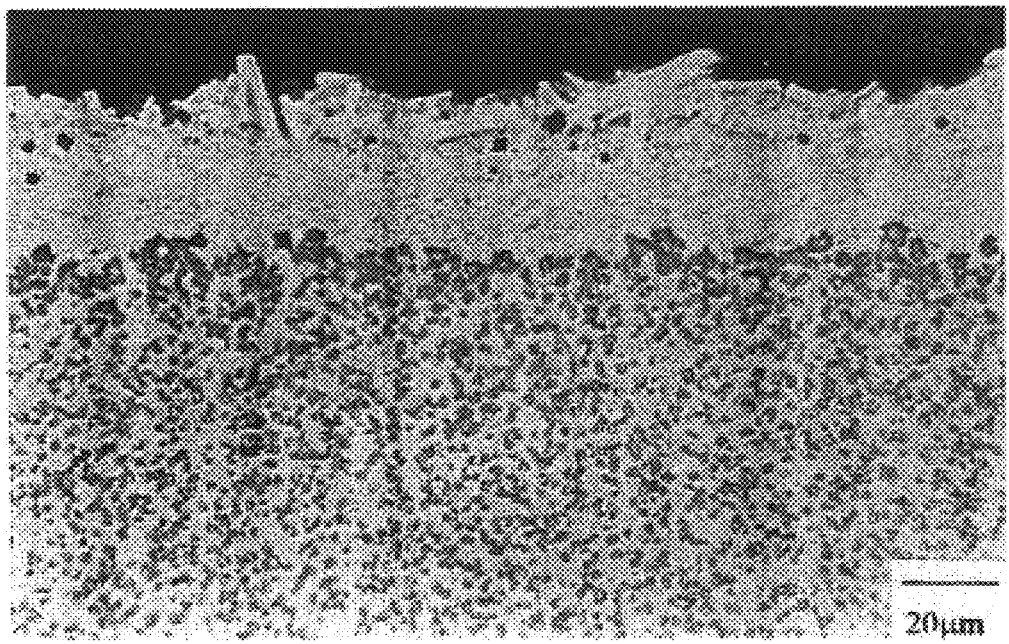
FIG. 9 is a microphotograph of an image of a further border zone structures of a sintered body.

As can be seen from FIG. 9, WC-crystallites project from the surface border zone which borders on an intermediate layer of a face-centered cubic phase of carbides, nitrides and carbonitrides of titanium, tantalum, niobium or tungsten. This layer does not have to be strictly single-phased or homogeneous, but can consist of phases which are richer or poorer on carbon. A certain proportion of binder materials is also bound into the intermediate layer. In the body interior, the border zone is immediately followed by the sintered core whose composition and layer structure correspond to the general composition. The described border structure, whose structure differs from the underlying layers, is formed particularly through heat treatment with changing temperatures, such as can be seen for instance from FIG. 8. If on the contrary one works with a constant temperature after the high sintering (see FIG. 1), such a face-centered cubic phase is barely formed; also transitions from WC—Co structure areas to (Ti,Ta,Nb,W) (C,N)- rich intermediate zones are more continuous and smoother. It can also be clearly seen that the WC crystallites visible in a sintered body according to FIG. 7 project less from the body surface, and therefore are more strongly bound into the surface zone than in the other described cases. However also in the structure formation according to FIG. 7 it can be clearly seen that the WC crystallite proportion increases towards the surface.

Figure 10:
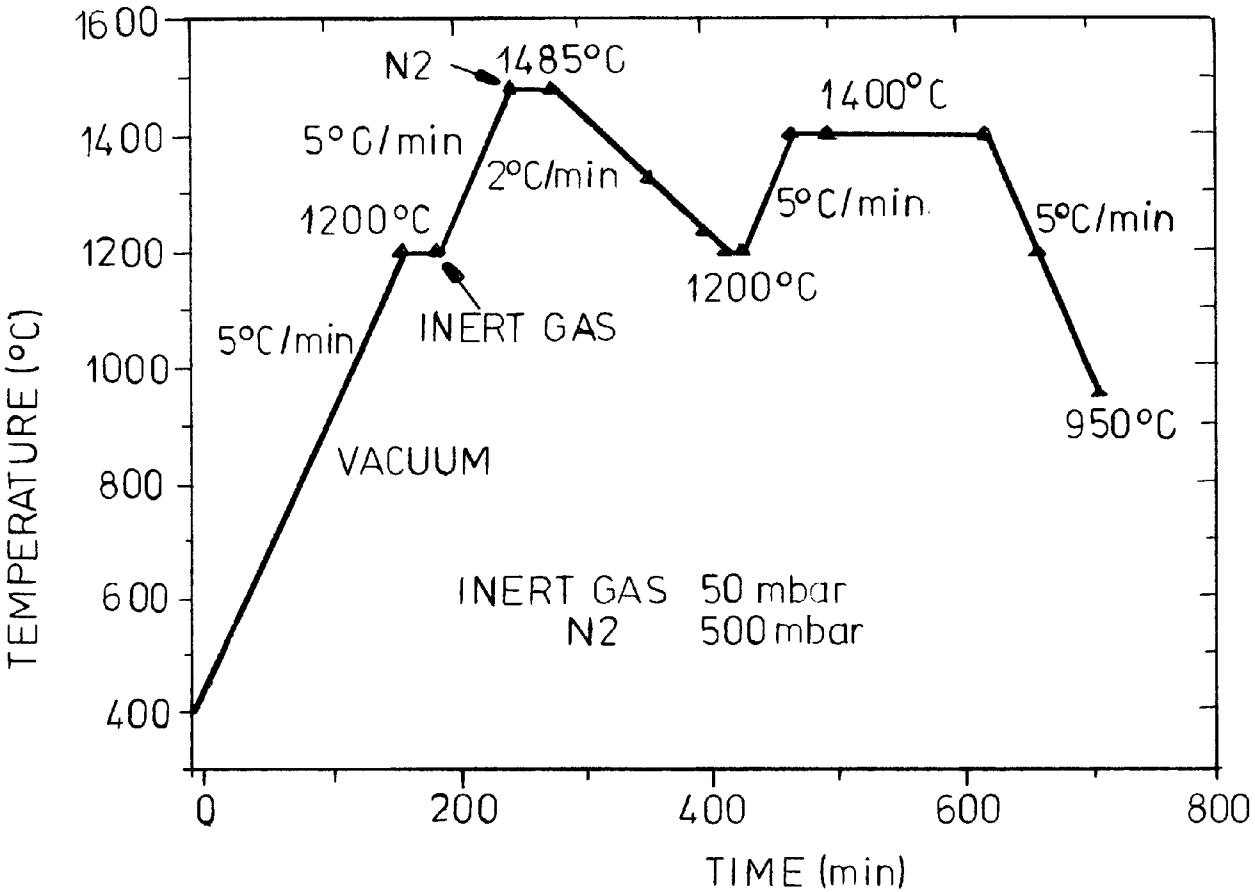
FIGS. 10 and 11 are temperature-time diagrams of further examples of process temperature management.
Figure 11:
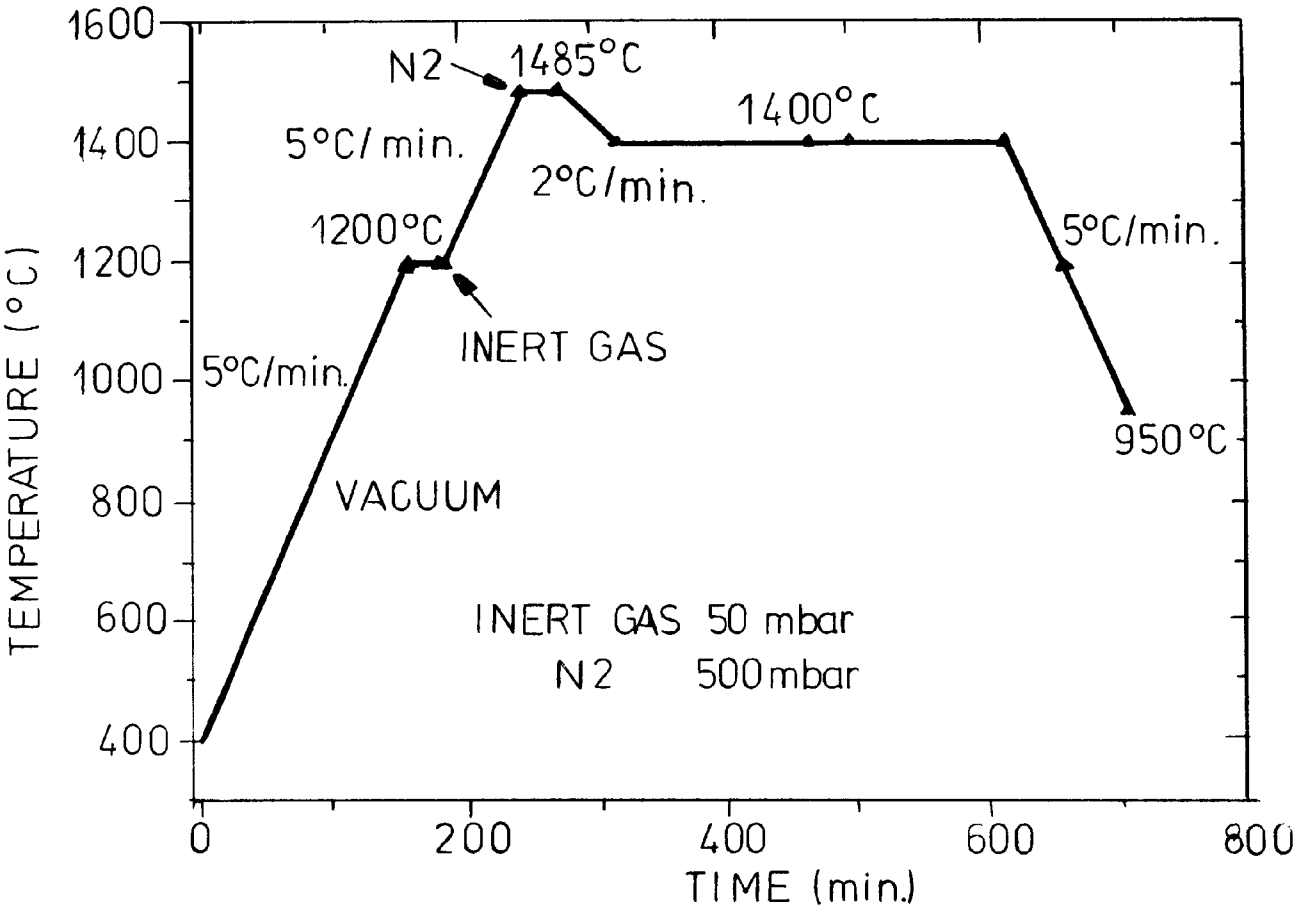

Variations in the temperature management can be seen from FIGS. 10 and 11. In the temperature profile shown in FIG. 10 the heating speed up to temperatures of 1200° C. and 1485° C. (sintering temperature) can be higher, namely, 5° C./min as compared to the lower heating speed according to the temperature profile of FIG. 8. The cooling speed subsequent to the holding time of the sintering temperature was selected to be 2° C./min. The heating speed of 1200° C. to 1400° C., as well as the cooling speed selected after a holding time of approximately 2½ hours amount to 5° C./min. In the process management according to FIG. 11 also a higher heating speed of 5° C. was selected in the two first heating phases, compared to FIG. 1, which shows clearly that lower heating speeds have been selected.

We claim:

1. A hard metal or cermet body consisting essentially of a hard material phase of at least one substance selected from the group which consists of WC and at least one carbide, nitride, carbonitride or oxycarbonitride of at least one element of Group IVa, Group Va or Group VIa of the periodic classification of elements in combination with a binder metal phase in an amount of 3 to 25 mass % and selected from the group which consists of Fe, Co and Ni, and having WC crystallites projecting from a surface of said body by 2 to 20 $\mu$m.

2. The hard metal or cermet body defined in claim 1 wherein the hard material phase consists of at least 50 mass % and at most 96 mass % WC.

3. The hard metal or cermet body defined in claim 2 wherein said WC crystallites form at said surface a cubic-phase composition consisting of at least 50 mass % by volume of binder metal and hard material other than WC.

4. The hard metal or cermet body defined in claim 3 wherein said cubic-phase composition is a single phase or multi-phase carbide, nitride, carbonitride or oxycarbonitride of at least one element of Group IVa, Group Va or Group VIa of the periodic classification of elements.

5. The hard metal or cermet body defined in claim 4 wherein said WC crystallites project from said surface by 5 to 10 μm and said cubic-phase composition is a single phase or multi-phase carbide, nitride, carbonitride or oxycarbonitride of titanium.

6. The hard metal or cermet body defined in claim 4 wherein said body includes compounds of at least one element selected from the group which consists of W, Ta, Nb, Mo and Cr.

7. The hard metal or cermet body defined in claim 4 wherein said cubic-phase composition contains 30 to 60 mass % Ti, 5 to 15 mass % of at least one element selected from the group which consists of Ta and Nb, 0 to 12 mass % Mo, 0 to 5 mass % V, 0 to 2 mass % Cr, 0 to 1 mass % of at least one element selected from the group which consists of Hf and Zr.

8. The hard metal or cermet body defined in claim 4 wherein said binder metal phase has at least one element selected from the group which consists of up to 2% Al, W, Ti, Mo, V and Cr dissolved therein.

9. The hard metal or cermet body defined in claim 1 which has a surface layer in the region of said surface consisting of at least three layers including: an outermost layer forming said surface and having a depth of 2 μm to 30 μm and consisting of a carbonitride phase free from said binder metal phase, an intermediate layer underlying said outermost layer and with a thickness of 5 μm to 150 μm of substantially pure WC—Co composition, and an innermost layer with a thickness of 10 μm to 650 μm and in which the contents of said binder metal phase and of elements of Group IVa and Group Va of the periodic classification of elements increase to a substantially constant value present in an interior of said body and a tungsten content which decreases to a substantially constant value in said interior of said body.

10. The hard metal or cermet body defined in claim 1 wherein said surface is formed on a surface zone of the body consisting of a plurality of layers of different compositions including an outermost layer forming said surface with a depth of 1 μm to 200 μm and a content of tungsten and said binder metal phase of at most 8 times the content of tungsten and binder metal phase in the body overall and in which the tungsten and binder metal phase content increases substantially continuously toward an interior of said body and a nitrogen content which decreases substantially continuously toward the interior of said body, and an intermediate layer underlying the outermost layer and having a thickness between 20 μm and 400 μm and in which tungsten and binder metal phase contents increase to a maximum with increasing depth and contents of elements of Group IVa and Group Va of the periodic classification decreases to a minimum and a third innermost layer underlying said intermediate layer and at a depth of a maximum of 1 μm measured from said surface the tungsten and binder phase contents decreasing to substantially constant values in the interior of the body and contents of Group IVa and Group Va elements of the periodic classification increasing to substantially constant values.

11. The hard metal or cermet body defined in claim 10 wherein at least one layer consists of a carbide, nitride or carbonitride of titanium or zirconium and includes at least one substance selected from the group which consists of $Al_2O_3$, diamond, cubic boron nitride, carbon nitride, fuller's earth and other compounds containing at least one of the elements B, C, A and O.

12. A method of producing a hard metal or cermet body consisting essentially of a hard material phase of at least one substance selected from the group which consists of WC and at least one carbide, nitride, carbonitride or oxycarbonitride of at least one element of Group IVa, Group Va or Group VIa of the periodic classification of elements in combination with a binder metal phase in an amount of 3 to 25 mass % and selected from the group which consists of Fe, Co and Ni, and having WC crystallites projecting from a surface of said body by 2 to 20 μm, said method comprising the steps of:

a. prepressing a nitrogen-free mixture of hard materials and binder metals into a green compact;

b. heating the green compact in a vacuum or an inert gas atmosphere to a temperature between 1200° C. and a sintering temperature;

c. admitting a nitrogen-containing and optionally carbon-containing atmosphere at a pressure between $10^3$ Pa to $10^7$ Pa to said green compact at the latest upon the green compact reaching said sintering temperature;

d. heating said green compact at said sintering temperature and heating the green compact at said sintering temperature for at least 20 minutes or cooling said green compact from said sintering temperature at a maximum rate of 2° C. per minute over 20 minutes;

e. cooling the resulting body to a temperature below 1000° C.; and f. maintaining said body in said atmosphere at least until the temperature drops to 1000° C.

13. A method of making a hard metal or cermet body consisting essentially of a hard material phase of at least one substance selected from the group which consists of WC and at least one carbide, nitride, carbonitride or oxycarbonitride of at least one element of Group IVa, Group Va or Group VIa of the periodic classification of elements in combination with a binder metal phase in an amount of 3 to 25 mass % and selected from the group which consists of Fe, Co and Ni, and having WC crystallites projecting from a surface of said body by 2 to 20 μm, said method comprising the steps of:

a. preshaping a mixture of hard material and binder metal containing at least two mass % of nitrogen-containing substances into a green compact;

b. heating said green compact to a sintering temperature with the initial heating being effective in an inert gas or vacuum;

c. replacing the atmosphere surrounding said green compact with a nitrogen-containing and optionally carbon-containing gas at a pressure of $10^3$ Pa to $10^7$ Pa as said green compact reaches a temperature of 1200° C. and until the green compact is at a sintering temperature;

d. sintering the green compact for at least 0.5 hour;

e. cooling the resulting sintered body to a temperature below 1000° C.;

f. maintaining the nitrogen-containing atmosphere established during heating above 1200° C. until the sintered body has been cooled at least to the temperature of 1000° C.

14. The method defined in claim 11 or 12 wherein the nitrogen-containing and optionally carbon-containing atmosphere is formed in situ by introducing into the presence of the green compact or sintered body nitrogen-containing and optionally carbon-containing precursors capable of forming the nitrogen-containing and optionally carbon-containing atmosphere.

15. The method defined in claim 12 or 13, further comprising the step of varying the temperature during cooling above and below a eutectic melting point by at least 20° C.

16. The method defined in claim 12 or 13 wherein, after said body reaches said sintering temperature, the atmosphere around said body cooled to approximately 1200° C. is raised to 1400° C. and then cooled again.

17. The method defined in claim 13 or 13 wherein the rate of heating and the rate of cooling are maintained between 2° C./min and 5°/min.

18. The method defined in claim 12 or 13 wherein the sintered body is subjected to a surface etching by a gas or liquid.

* * * * *